US011808506B2

(12) United States Patent
Oshima

(10) Patent No.: US 11,808,506 B2
(45) Date of Patent: Nov. 7, 2023

(54) ICE MAKING MACHINE

(71) Applicant: NIDEC SANKYO CORPORATION, Nagano (JP)

(72) Inventor: Yuta Oshima, Nagano (JP)

(73) Assignee: NIDEC SANKYO CORPORATION, Nagano (JP)

( * ) Notice: Subject to any disclaimer, the term of this patent is extended or adjusted under 35 U.S.C. 154(b) by 0 days.

(21) Appl. No.: 17/586,814

(22) Filed: Jan. 28, 2022

(65) Prior Publication Data

US 2022/0243970 A1 Aug. 4, 2022

(30) Foreign Application Priority Data

Jan. 29, 2021 (JP) ..... 2021-013297

(51) Int. Cl.
*F25C 1/04* (2018.01)

(52) U.S. Cl.
CPC ..... *F25C 1/04* (2013.01); *F25C 2305/0221* (2021.08)

(58) Field of Classification Search
CPC ..... F25C 1/04; F25C 2305/0221
USPC ..... 62/340
See application file for complete search history.

(56) References Cited

U.S. PATENT DOCUMENTS

2012/0023996 A1* 2/2012 Herrera ..... F25C 1/04 249/70
2012/0240613 A1* 9/2012 Saito ..... F25C 5/187 62/379
2019/0063809 A1* 2/2019 Saito ..... F25C 1/04
2019/0063813 A1* 2/2019 Saito ..... F25C 1/10
2019/0093935 A1* 3/2019 Saito ..... F25C 1/243
2020/0240695 A1* 7/2020 Saito ..... F25C 1/25
2020/0284492 A1* 9/2020 Saito ..... F25D 17/062

FOREIGN PATENT DOCUMENTS

CN 111854249 A * 10/2020 ..... F25C 1/04
JP 2020143833 A 9/2020

OTHER PUBLICATIONS

CN-111854249-A machine translation (Year: 2023).*

* cited by examiner

*Primary Examiner* — Len Tran
*Assistant Examiner* — Kirstin U Oswald
(74) *Attorney, Agent, or Firm* — HAUPTMAN HAM, LLP

(57) ABSTRACT

An ice making machine has a framework-shaped frame which encloses an ice making tray and a drive unit and a fixing portion which fixes the frame to an inner wall surface in a freezing compartment. The frame includes a first frame portion and a second frame portion opposed to each other in an X-axis direction and a third frame portion and a fourth frame portion opposed to each other in a Y-axis direction. The fixing portion protrudes upward from the third frame portion. The third frame portion contacts the inner wall surface when the frame is fixed to the freezing compartment. The fourth frame portion includes a plate portion which extends in the X-axis direction with a thickness direction directed to the Y-axis direction and connects the first frame portion and the second frame portion to each other and a plurality of ribs provided on the plate portion.

6 Claims, 6 Drawing Sheets

ICE MAKING MACHINE

RELATED APPLICATIONS

The present application claims priority to Japanese Application No. 2021-013297 filed Jan. 29, 2021, the disclosure of which is hereby incorporated by reference herein in its entirety.

BACKGROUND

Field of the Invention

At least an embodiment of the present invention relates to an ice making machine which is fixed to an inner wall surface in a freezing compartment and produces ice in the freezing compartment. More specifically, it relates to an ice making machine that inverts an ice making tray to drop the produced ice.

Description of the Related Documents

The ice making machine as above is described in JP 2020-143833. The ice making machine in the document has an ice making tray, a drive unit which rotates the ice making tray around an axis passing through the ice making tray, and a frame made of a resin which encloses the ice making tray and the drive unit. The frame has a frame structure and is rectangular in shape when viewed from above. The frame has front and rear plate portions opposed to each other in a longitudinal direction, and right and left plate portions opposed to each other in a short-length direction. The ice making tray and the drive unit are arranged in the longitudinal direction of the frame, and the axis which is a rotation center of the ice making tray extends in the longitudinal direction. In the longitudinal direction, assuming that a side on which the ice making tray is located is a first direction and a side opposite to that is a Z2 direction, the front plate portion is located in the first direction of the ice making tray and the rear plate portion is located in the Z2 direction of the drive unit. The drive unit is held at an end portion of the frame in the Z2 direction.

The front plate portion includes a support portion which rotatably supports a support shaft which protrudes in the first direction from the ice making tray. The front plate portion includes a contact portion which can contact a portion separated from the support shaft of the ice making tray, from front in the rotation direction of the ice making tray. The left plate portion has a fixing portion which protrudes upward from two locations separated in the longitudinal direction. When the frame is fixed to an inner wall surface in a freezing compartment, fixing screws are screwed into a side surface portion of the inner wall surface through each of protruding portions. When the frame is fixed to the inner wall surface, the left plate portion is in contact with the side surface portion of the inner wall surface in the freezing compartment. The right plate portion is a thin-walled flat plate and extends in the longitudinal and vertical directions to connect the front plate portion and the rear plate portion to each other.

In the ice making machine, the drive unit is driven for a predetermined period of time when ice is produced in the ice making tray. This causes the ice making tray, which is faced upward, to rotate around its axis to be faced downward. In the ice making machine, the contact portion provided on the front plate portion contacts the ice making tray before driving of the drive unit is finished. As a result, the ice making tray has an end portion in the second direction rotated by a driving force of the drive unit with the contact portion in contact with an end portion in the first direction thereof from the front in the rotation direction. As a result, the ice making tray is twisted, so the ice is removed from the ice making tray and falls.

When the ice making tray is twisted, a reaction force of the driving force acts on the front plate portion on which the contact portion is provided and the end portion in the Z2 direction of the frame which holds the drive unit. Therefore, when the ice making tray is twisted, the frame might be distorted in some cases.

Here, in a configuration in which the fixing portion which fixes the frame to the inner wall surface in the freezing compartment protrudes upward from the left plate portion, as in JP 2020-143833, if the frame is distorted when the ice making tray is twisted, such a problem may occur that a lower end portion of the left plate portion is lifted up from the inner wall surface in the freezing compartment.

In view of the above problem, an object of at least an embodiment of the present invention is to provide an ice making machine capable of preventing or suppressing distortion in a frame fixed to an inner wall surface in a freezing compartment when an ice making tray is twisted.

SUMMARY

In order to solve the above problem, the ice making machine of at least an embodiment of the present invention includes an ice making tray, a drive unit which rotates the ice making tray around an axis passing through the ice making tray, a framework-shaped frame which encloses the ice making tray and the drive unit, and a fixing portion which fixes the frame to a side surface portion of an inner wall surface in a freezing compartment, in which the ice making tray and the drive unit are arranged in an axis direction along the axis, the frame is made of resin and, assuming that a side on which the ice making tray is located in the axis direction is a first direction and a side opposite thereto is a second direction, includes a first frame portion located in the first direction of the ice making tray, a second frame portion located in the second direction of the drive unit, a third frame portion extending in the axis direction and connecting the first frame portion and the second frame portion, and a fourth frame portion opposed to the third frame portion and connecting the first frame portion and the second frame portion, the first frame portion includes a support portion which supports the ice making tray rotatably around the axis and a contact portion which can contact a portion that is separated from the axis of the ice making tray, from front in a rotation direction of the ice making tray, the drive unit is held inside the second frame portion, an end portion in the second direction of the third frame portion, and an end portion in the second direction of the fourth frame portion, the fixing portion protrudes upward from the third frame portion, the third frame portion contacts the side surface portion when the frame is fixed to the side surface portion, the fourth frame portion includes a plate portion which extends in the axis direction with a thickness direction directed to an orthogonal direction orthogonal to the axis direction and connects the first frame portion and the second frame portion to each other and a plurality of ribs provided on the plate portion, and if the drive unit is driven for a predetermined period of time when the ice making tray is faced upward, the ice making tray is rotated and faced downward, and the contact portion contacts the ice making tray and the ice making tray is twisted before driving of the drive unit is finished.

According to at least an embodiment of the present invention, in the frame, the third frame portion on which the fixing portion is provided contacts the side surface portion of the inner wall surface in the freezing compartment when it is fixed to the freezing compartment by using the fixing portion. Accordingly, when a reaction force of the driving force acts on the frame while the ice making tray is twisted, the third frame portion is supported by the side surface portion of the freezing compartment and is suppressed from being distorted. Moreover, in the frame, the fourth frame portion opposed to the third frame portion includes the plate portion and the plurality of ribs. Therefore, the fourth frame portion has increased rigidity as compared with a case where the fourth frame portion is constituted only by plate portions. Thus, distortion of the frame by the reaction force of the driving force when the ice making tray is twisted can be prevented or suppressed.

In at least an embodiment of the present invention, it is desirable that the fourth frame portion includes an opposing plate portion that opposes the plate portion and extends in the axis direction and in the Z-axis direction and connects distal ends of the plurality of ribs. In this way, the rigidity of the fourth frame portion is increased. Therefore, the distortion of the frame when the ice making tray is twisted can be suppressed more easily.

In at least an embodiment of the present invention, each rib extends from an upper end to a lower end of the plate portion, and the plurality of ribs may extend in parallel. In this way, the fourth frame portion has a shape similar to that of a plate portion including a plurality of through holes penetrating in a vertical direction in a plate part having a thickness larger than or equal to the sum of the thickness of the plate portion and the thickness of the opposing plate portion. Accordingly, when the frame is formed by injection molding of resin, the plurality of through holes extending in the vertical direction serve as wall thinning of the thick plate part and can prevent or suppress occurrence of sink marks on the fourth frame portion. Therefore, it becomes easy to form the frame into the desired shape.

In at least an embodiment of the present invention, it may be so constituted that, as the fixing portions, a first fixing portion and a second fixing portion which protrude upward from two locations separated in the axis direction of the third frame portion are provided, and the first fixing portion is located between the drive unit and the contact portion in the axis direction, while the second fixing portion is located closer to the first direction than the first fixing portion in the axis direction.

In this case, wiring for power feed which is connected to the drive unit is provided, and the third frame portion includes a notched portion opened downward at an overlapping position overlapping the first fixing portion when viewed from the vertical direction or closer to the first direction than the overlapping position when viewed from the vertical direction, and the wiring is routed inside the frame from the drive unit to the notched portion and pulled out to an outside of the frame through the notched portion. In this way, the wiring connected to the drive unit can be pulled out of the frame. Here, in a configuration in which the first fixing portion is positioned between the drive unit and the contact portion in the axis direction and the second fixing portion is positioned in the axis direction closer to the first direction than the first fixing portion among the fixing portions that fix the frame to the side surface portion of the freezing compartment, if the frame is distorted when the ice making tray is twisted, a lower end portion of the third frame portion, especially the side closer to a drive source that exerts the driving force to rotate the ice making tray, tends to be lifted up from the side surface portion of the freezing compartment. Accordingly, when the notched portion is provided in the third frame portion, the rigidity of the third frame portion is lowered and thus, the lower end portion of the third frame portion, which is the side closer to the drive source, is more likely to be lifted up from the side surface portion of the freezing compartment. Regarding such a problem, by providing the notched portion on the overlapping portion which overlaps the first fixing portion when viewed from the vertical direction or closer to the first direction than the overlapping position when viewed from the vertical direction, the notched portion can be separated from the drive unit as compared with the case where the notched portion is provided closer to the Z2 direction than the overlapping portion. As a result, occurrence of lowering of the rigidity on the side closer to the drive unit of the third frame portion can be suppressed and thus, when the ice making tray is twisted, lifting-up of the side closer to the drive unit of the third frame portion from the side surface portion of the freezing compartment can be easily suppressed.

In at least an embodiment of the present invention, the notched portion may be provided at the overlapping position. In this way, the notched portion is provided closer to the first fixing portion. Accordingly, when the frame is fixed to the side surface portion of the freezing compartment using the first fixing portion, a state where a vicinity around the notched portion in contact with the side surface portion of the freezing compartment can be realized easily. As a result, since the vicinity of the notched portion in the third frame portion is supported by the inner wall surface in the freezing compartment when the ice making tray is twisted, occurrence of distortion in the third frame portion can be easily suppressed.

In at least an embodiment of the present invention, it may be so constituted that the third frame portion includes a first plate portion extending from the first frame portion in the second direction on the side of the ice making tray and having a first end opposite to the first frame portion located between the drive unit and the contact portion in the axis direction, a second plate portion extending from the second frame portion in the first direction on the side of the drive unit at a position more separated from the ice making tray than the first plate portion and having a second end opposite to the second frame portion separated from the first end in the axis direction, a connecting plate portion which extends in a direction crossing the axis and connects the first end and the second end to each other, and the notched portion provided on a lower end portion of the connecting plate portion, on a surface opposite to the fourth frame portion of the first plate portion, a first plate-portion side upper-end rib extending in the axis direction along an upper end of the first plate portion, a first plate-portion lower-end rib extending in the axis direction along a lower end of the first plate portion, and a notched-portion side rib which overlaps the notched portion when viewed from the axis direction in the first direction of the notched portion are provided, on a surface opposite to the fourth frame portion of the second plate portion, a second plate-portion rib is provided, the first fixing portion and the second fixing portion protrude upward from an end opposite to the fourth frame portion of the first plate-portion upper-end rib, a distal end surface of the first plate-portion upper-end rib, a distal end surface of the first plate-portion lower-end rib, and a distal end surface of the second plate-portion rib are located on the same virtual plane and are brought into contact with the side surface portion when the frame is fixed to the side surface portion, and a distal end surface of the notched-portion side rib is located closer to the first plate portion than the virtual plane.

In this way, a step portion is formed by the first plate portion, the second plate portion and the connecting plate portion on the inner wall surface facing sides of the ice making tray and the drive unit in the third frame portion. Moreover, in a lower end portion of the step portion that is the lower end portion of the connecting plate portion, a notched portion through which the wiring is pulled out is provided. Here, the second plate portion provided on the side of the drive unit is more separated from the ice making tray than the first plate portion. Accordingly, if the wiring connected to the drive unit is routed along the second plate portion and pulled out through the notched portion to the outside of the frame, contact of the wiring routed inside the frame with the ice making tray can be prevented or suppressed. Moreover, by providing a notched portion in the step portion, bending of the wiring can be suppressed when it is pulled out to the outside through the notched portion. Here, on the first plate portion, the first plate-portion upper-end rib extending along the upper end, the first plate-portion lower-end rib extending along the lower end, and the notched-portion side rib located in the first direction of the notched portion are provided. Moreover, on the second plate portion, a second plate-portion rib is provided. Accordingly, as compared with a case where the third frame portion is constituted only by the first plate portion, the second plate portion, and the connecting plate portion, the rigidity of the third frame portion is improved. Furthermore, the first fixing portion and the second fixing portion which fix the frame to the side surface portion of the freezing compartment protrude upward from the end opposite to the fourth frame portion of the first plate-portion upper-end rib. Accordingly, when the frame is to be fixed to the side wall surface of the freezing compartment using the first fixing portion and the second fixing portion, the side of the third frame portion opposite to the fourth frame portion can be brought into contact with the side surface portion of the freezing compartment easily. Moreover, the distal end surface of the first plate-portion upper-end rib, the distal end surface of the second plate-portion side upper-end rib, and the distal end surface of the second plate-portion rib are located on the same virtual plane and are brought into contact with the side surface portion when the frame is fixed to the side surface portion of the freezing compartment. Therefore, the third frame portion is supported by the side surface portion of the freezing compartment. Moreover, since the distal end surface of the notched-portion side rib is located closer to the first plate portion than the virtual plane, a clearance is formed between the notched-portion side rib and the side surface portion of the freezing compartment when the distal end surface of the first plate-portion upper-end rib, the distal end surface of the second plate-portion side upper-end rib, and the distal end surface of the second plate-portion rib are brought into contact with the side surface portion of the freezing compartment. Therefore, when the wiring is pulled out of the frame through the notched portion formed in the third frame portion, the wiring can be routed from the notched portion in the first direction by using this clearance. As a result, separation of the third frame portion from the side surface portion of the freezing compartment can be prevented even when the wiring is pulled out of the frame.

According to at least an embodiment of the present invention, in the frame, the third frame portion on which the fixing portion is provided contacts the side surface portion of the inner wall surface in the freezing compartment when it is fixed to the freezing compartment by using the fixing portion. Accordingly, when a reaction force of the driving force acts on the frame while the ice making tray is twisted, the third frame portion is supported by the side surface portion of the freezing compartment and is suppressed from being distorted. Moreover, in the frame, the fourth frame portion opposed to the third frame portion includes the plate portion and the plurality of ribs. Therefore, the fourth frame portion has increased rigidity as compared with a case where the fourth frame portion is constituted only by plate portions. Thus, distortion of the frame by the reaction force of the driving force when the ice making tray is twisted can be prevented or suppressed.

BRIEF DESCRIPTION OF THE DRAWINGS

Embodiments will now be described, by way of example only, with reference to the accompanying drawings which are meant to be exemplary, not limiting, and wherein like elements are numbered alike in several figures, in which.

DETAILED DESCRIPTION

Figure 1:
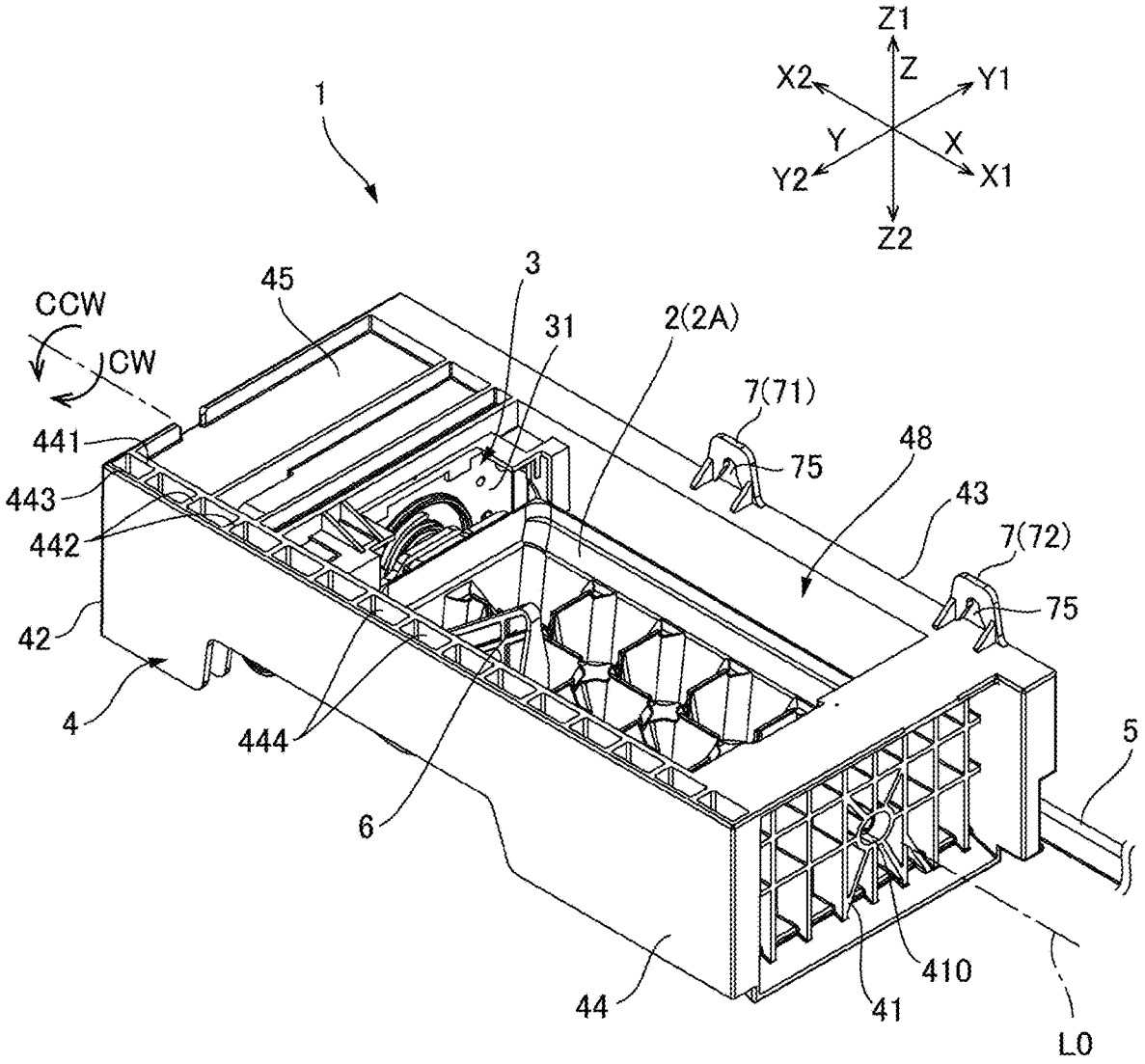
FIG. 1 is a perspective view of an ice making machine when viewed from above, to which at least an embodiment of the present invention is applied.

Referring to the drawings, an embodiment of an ice making machine to which at least an embodiment of the present invention is applied will be described below.

Overall Configuration

Figure 2:
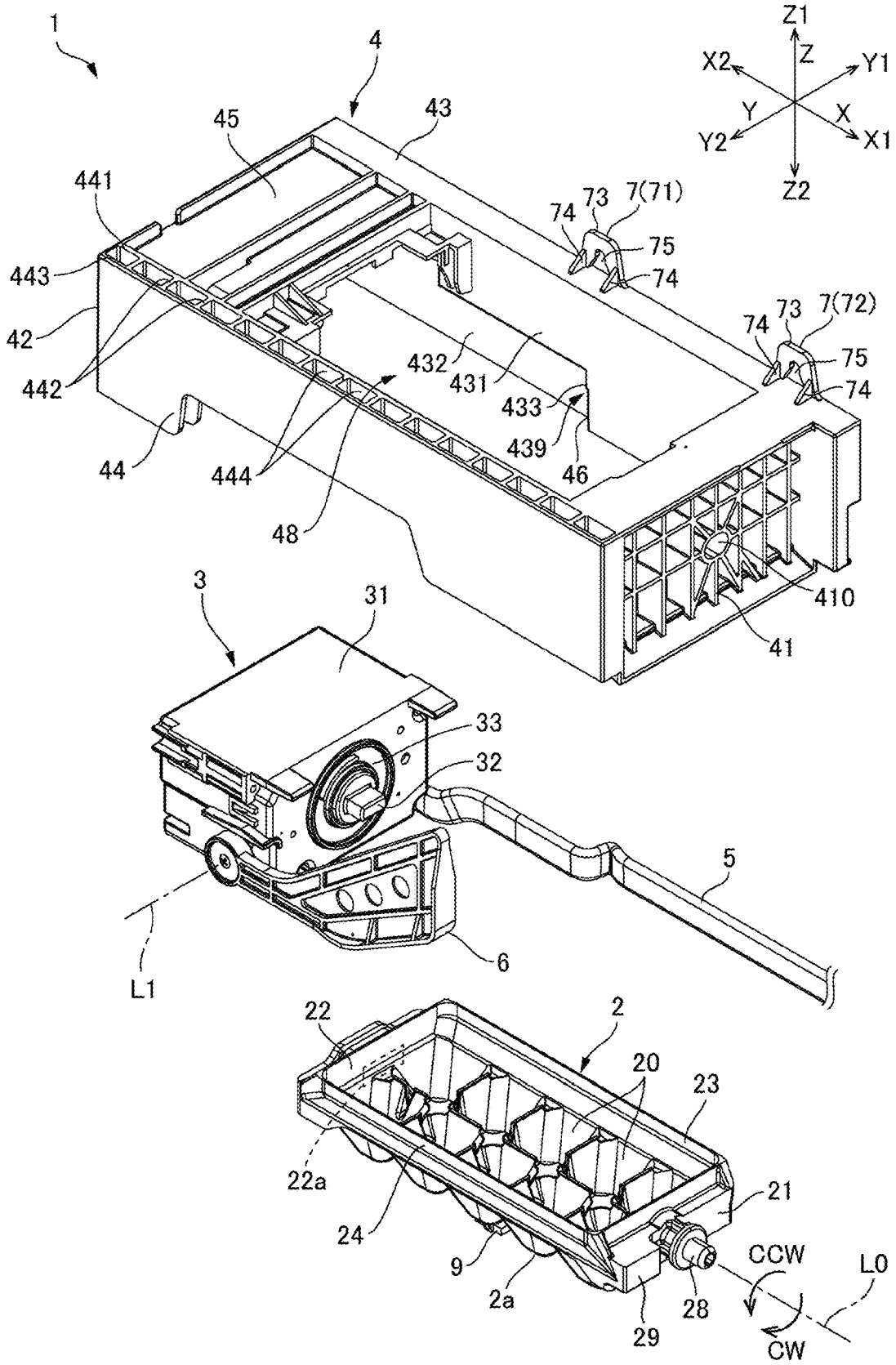
FIG. 2 is an exploded perspective view of the ice making machine in FIG. 1.
Figure 3:
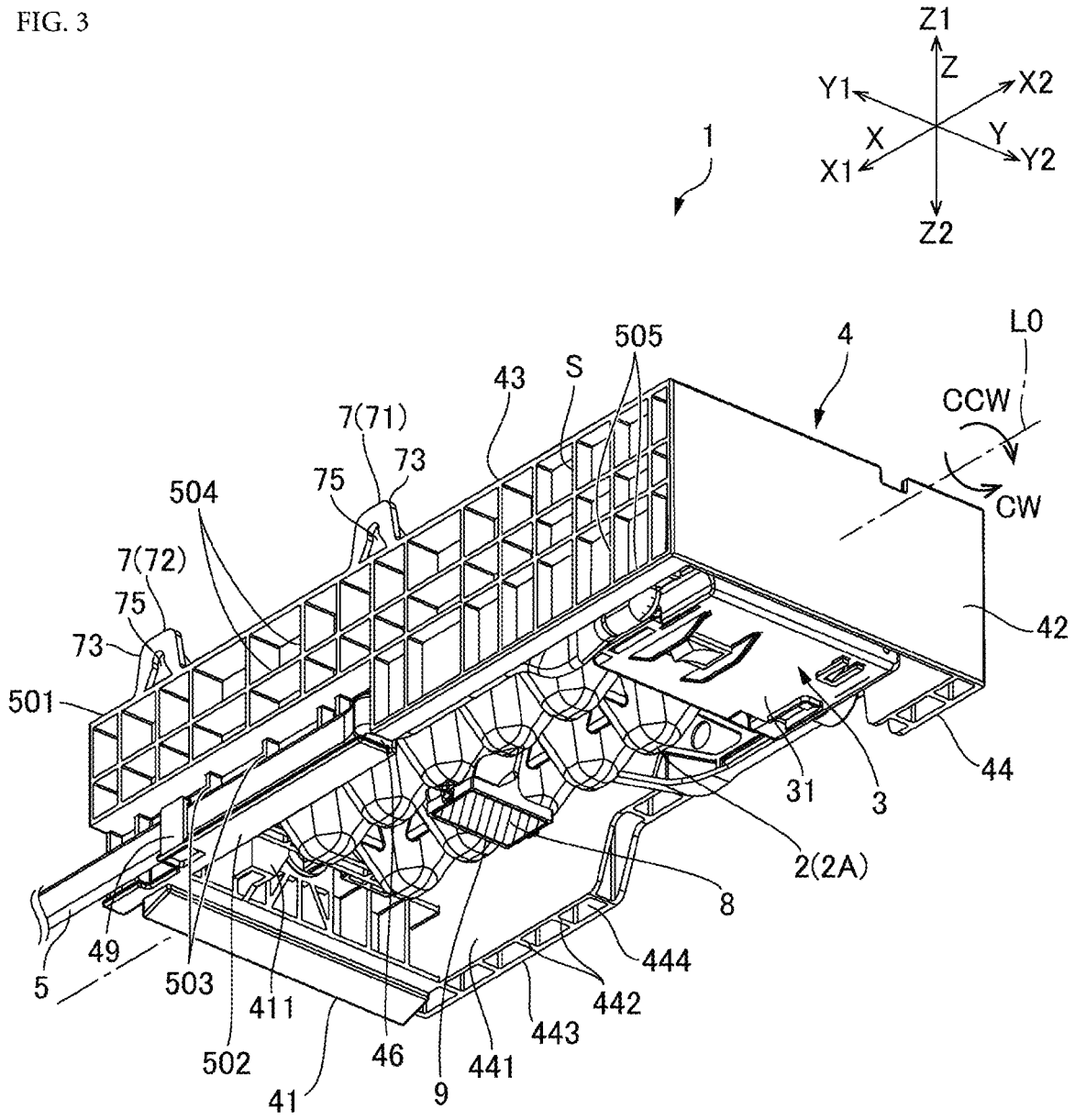
FIG. 3 is a perspective view of the ice making machine when viewed from below in a state where an ice making tray is faced upward.
Figure 4:
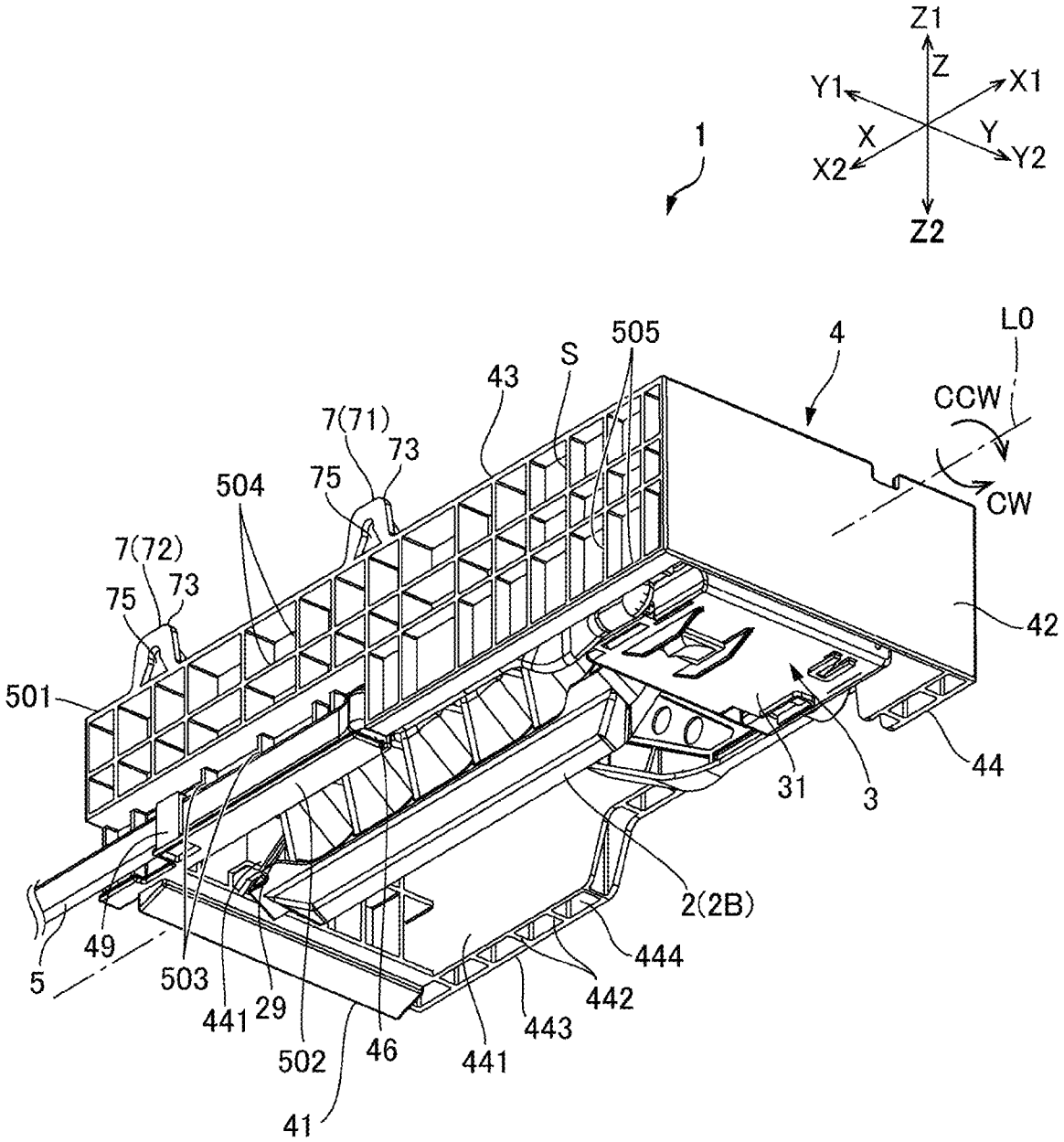
FIG. 4 is a perspective view of the ice making machine when viewed from below in a state where the ice making tray is faced downward.

FIG. 1 is a perspective view of the ice making machine when viewed from above, to which at least an embodiment of the present invention is applied. FIG. 2 is an exploded perspective view of the ice making machine in FIG. 1. In FIGS. 1 and 2, the ice making machine is viewed from a side where an ice making tray is located. FIG. 3 is a perspective view of the ice making machine when viewed from below in a state where the ice making tray is faced upward. FIG. 4 is a perspective view of the ice making machine when viewed from below in a state where the ice making tray is faced downward. In FIGS. 3 and 4, the ice making machine is viewed from a side of a drive unit which rotates the ice making tray.

The ice making machine 1 is used by being fixed to a side wall portion of an inner wall surface in a freezing compartment of a refrigerator. As shown in FIG. 1, the ice making machine 1 includes an ice making tray 2, a drive unit 3 which rotates the ice making tray 2, and a framework-shaped frame 4 which encloses the ice making tray 2 and the drive unit 3. The ice making tray 2 and the drive unit 3 are held in the frame 4. Moreover, the ice making machine 1 has a fixing portion 7 which fixes the frame 4 to a side surface portion of an inner wall surface in the freezing compartment. When the frame 4 is fixed to the side wall portion of the refrigerator, the ice making machine 1 is located above the ice storage box which stores ice.

The ice making tray 2 has an overall rectangular outline shape when viewed from above. The drive unit 3 is disposed on one side in a longitudinal direction of the ice making tray 2. The drive unit 3 rotates the ice making tray 2 around an axis L0 passing through a center in a short-length direction of the ice making tray 2 in the longitudinal direction. The frame 4 is rectangular in shape when viewed in a vertical direction. The longitudinal direction of the ice making tray 2 and the longitudinal direction of the frame 4 are the same. The frame 4 includes a first frame portion 41 and a second frame portion 42 opposed to each other in the longitudinal direction of the ice making tray 2 and a third frame portion 43 and a fourth frame portion 44 opposed to each other in the short-length direction of the ice making tray 2. The fixing portion 7 protrudes upward from the third frame portion 43.

By driving of the drive unit 3, the ice making tray 2 moves between a water storage position 2A facing upward and an ice release position 2B facing downward. The water storage position 2A is a position where water can be stored in the ice making tray 2. The ice release position 2B is a position where produced ice is dropped from the ice making tray 2 into an ice storage compartment. In FIGS. 1 and 3, the ice making tray 2 is disposed at the water storage position 2A. In FIG. 4, the ice making tray 2 is disposed at the ice release position 2B.

In the following description, three directions orthogonal to one another are supposed to be an X-axis direction, a Y-axis direction, and a Z-axis direction. The X-axis direction is an axis direction along the axis L0. Moreover, the X-axis direction is a direction in which the first frame portion 41 and the second frame portion 42 are opposed to each other. The Y-axis direction is a direction in which the third frame portion 43 and the fourth frame portion 44 are opposed to each other. The Z-axis direction is the vertical direction. Moreover, one side of the X-axis direction is supposed to be an X1 direction and the other side to be an X2 direction. The X1 direction is a side where the ice making tray 2 is located, and the X2 direction is a side where the drive unit 3 is located. In addition, the X1 direction is the side on which the first frame portion 41 is located, and the X2 direction is the side on which the second frame portion 42 is located. Furthermore, one side of the Y-axis direction is supposed to be a Y1 direction, and the other side to be a Y2 direction. The Y1 direction is a side on which the third frame portion 43 is located, and the Y2 direction is a side on which the fourth frame portion 44 is located. Moreover, an upward direction is supposed to be a Z1 direction and a downward direction to be the Z2 direction.

Ice Making Tray

The ice making tray 2 is made of resin. As shown in FIG. 2, the ice making tray 2 includes a rectangular-shaped frame portion 25 and a plurality of water-storage recess portions 20 provided inside the frame portion 25. Regarding the water-storage recess portions 20, sets of two water-storage recess portions arranged in the Y-axis direction are aligned in plural in the X-axis direction. The frame portion 25 includes a first side-wall portion 21 located in the X1 direction of the plurality of water-storage recess portions 20, a second side-wall portion 22 located in the X2 direction of the plurality of water-storage recess portions 20, a third side-wall portion 23 located in the Y1 direction of the plurality of water-storage recess portions 20, and a fourth side-wall portion 24 located in the Y2 direction of the plurality of water-storage recess portions 20.

In a center part in the Y-axis direction of the first side-wall portion 21, a protruding shaft portion 28 in the Y1 direction is provided. The shaft portion 28 is coaxial with the axis L0. Moreover, on a portion of the first side-wall portion 21 which is separated from the axis L0, a protruding portion 29 which protrudes in the X1 direction is provided. In this embodiment, the protruding portion 29 is provided on a side of the shaft portion 28 and at an end portion of the first side-wall portion 21 on the side of the fourth side-wall portion 24. In a center part in the Y-axis direction of the second side-wall portion 22, a connecting portion 22*a* connected to the drive unit 3 is provided. The connecting portion 22*a* is located on the axis L0. As shown in FIG. 3, a thermistor holder 9 is fixed to a lower surface 2*a* of the ice making tray 2. Inside the thermistor holder 9, a thermistor 8 which detects a temperature of the lower surface 2*a* of the ice making tray 2 is accommodated.

Drive Unit

As shown in FIG. 2, the drive unit 3 includes a cuboid-shaped case 31 and an output shaft 32 protruding from the case 31 in the X1 direction. In the case 31, a motor, which is a drive source, and a rotation transmission mechanism, which transmits rotation of the motor to the output shaft 32, are accommodated. The output shaft 32 is connected to the connecting portion 22*a* of the ice making tray 2. When the ice making tray 2 is rotated from the water storage position 2A to the ice release position 2B, the drive unit 3 rotates the output shaft 32 in a CCW direction. When the ice making tray 2 is rotated from the water storage position 2A to the ice release position 2B, the drive unit 3 rotates the output shaft 32 in a CW direction.

As shown in FIG. 3, wiring 5 which supplies power to the drive source is connected to the drive unit 3. The wiring 5 is pulled out of an end portion in the Y1 direction of the case 31 in the X1 direction. An ice checking lever 6 is disposed at a position adjacent to the ice making tray 2 in the Y2 direction. The drive unit 3 rotates the ice checking lever 6 around an axis L1.

Frame

Figure 5:
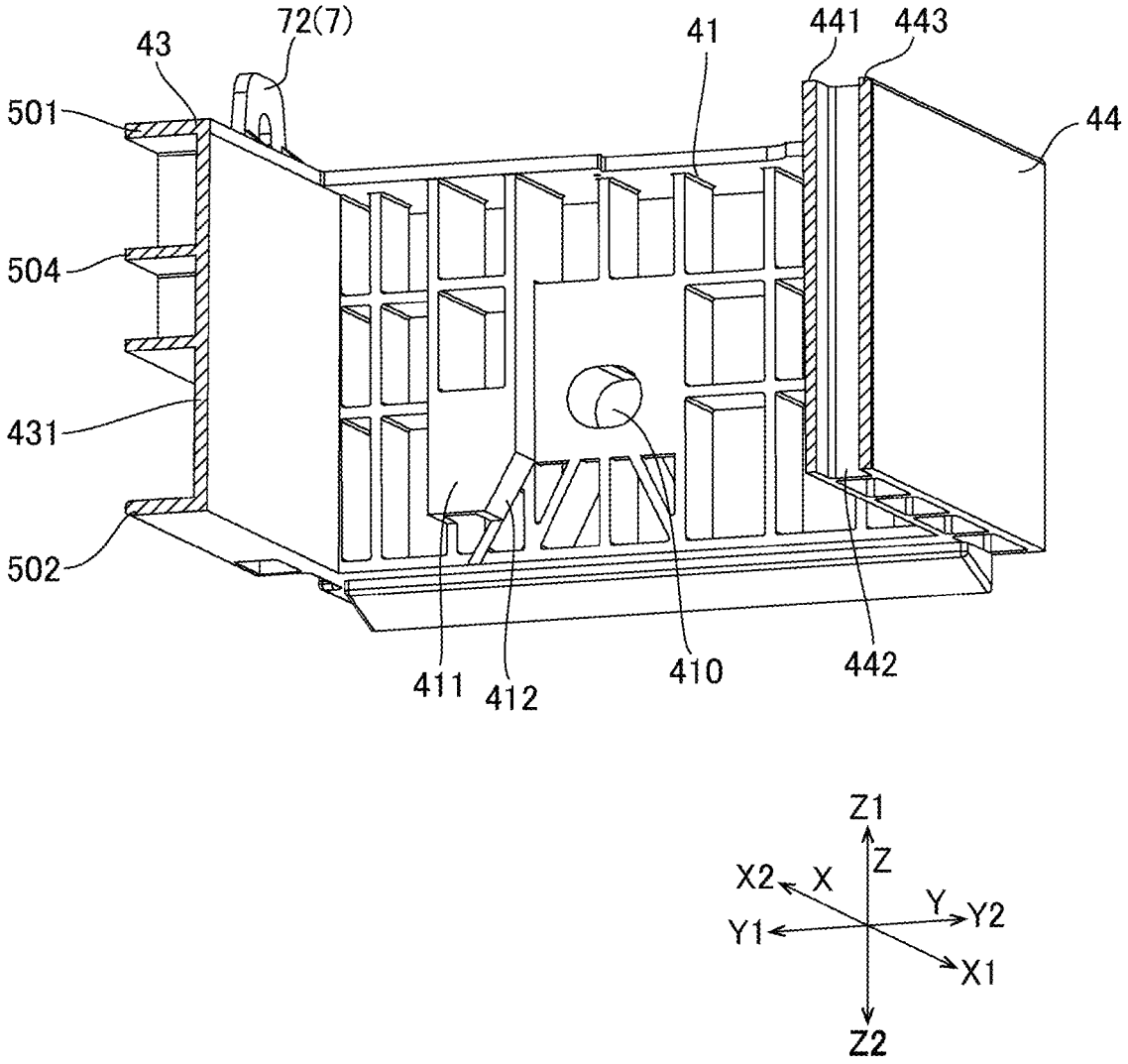
FIG. 5 is a cross-sectional view of the frame when it is cut on a plane orthogonal to an axis.
Figure 6:
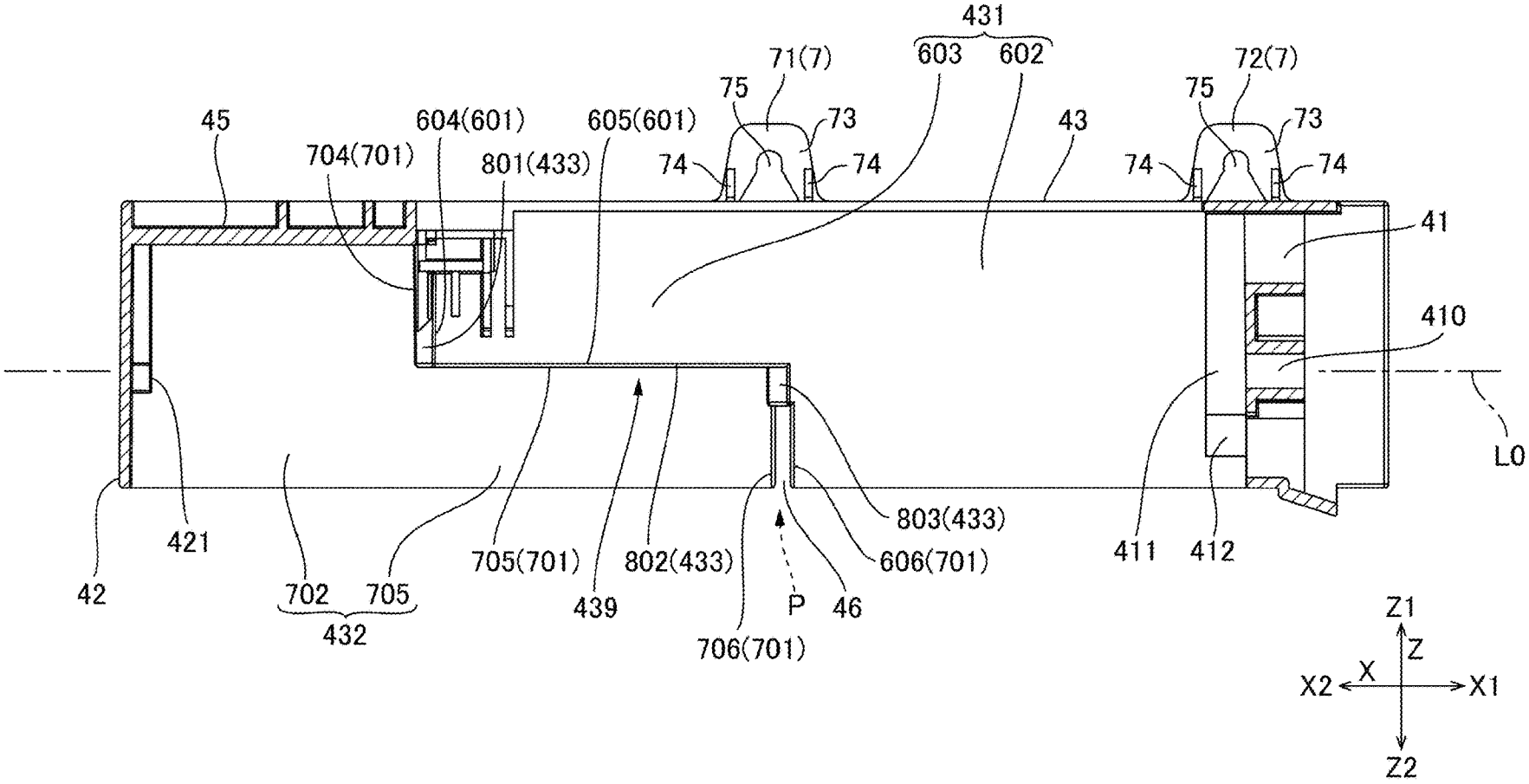
FIG. 6 is a cross-sectional view of the frame when it is cut along the axis.

FIG. 5 is a cross-sectional view of the frame 4 when it is cut in a plane orthogonal to the axis L0. In FIG. 5, the first frame portion 41 is viewed from below in the X2 direction. FIG. 6 is a cross-sectional view of the frame 4 when it is cut along the axis L0. In FIG. 6, the third frame portion 43 is viewed from the Y2 direction.

The frame 4 is made of resin. As shown in FIG. 2, the frame 4 includes the first frame portion 41, the second frame portion 42, the third frame portion 43, and the fourth frame portion 44 which form a rectangular frame shape. Moreover, the frame 4 includes a rectangular support frame portion 45 which connects an upper end portion of the second frame portion 42, an end portion in the X2 direction of the third frame portion 43, and an end portion in the X2 direction of the fourth frame portion 44. In the X1 direction of the support frame portion 45, a rectangular opening portion 48 is defined by an end edge in the X1 direction of the support frame portion 45, the first frame portion 41, the third frame portion 43, and the fourth frame portion 44.

The first frame portion 41 is located in the X1 direction of the ice making tray 2. The second frame portion 42 is located in the X2 direction of the drive unit 3. The third frame portion 43 extends in the X-axis direction and connects the first frame portion 41 and the second frame portion 42 to each other. The fourth frame portion 44 is opposed to the third frame portion 43 in the Y-axis direction and connects the first frame portion 41 and the second frame portion 42 to each other. The drive unit 3 is fixed to the support frame portion 45 from below Z2. The drive unit 3 is held by the second frame portion 42, the end portion in the X2 direction of the third frame portion 43, and an end portion in the X2 direction of the fourth frame portion 44 via the support frame portion 45.

First Frame Portion

The first frame portion 41 is a porous wall with a plurality of plate-like ribs connected to each other. As shown in FIG. 5, the first frame portion 41 includes a support portion 410 that supports the shaft portion 28 of the ice making tray 2 rotatably around the axis L0. The support portion 410 is a circular through hole penetrating through the first frame portion 41 in the X-axis direction. The ice making tray 2 rotates around an axis L in a state where the shaft portion 28 is supported by the support portion 410, and the connecting portion 22*a* is connected to the output shaft 32 of the drive unit 3.

In addition, the first frame portion 41 includes a protruding portion 411 that protrudes in the X2 direction in the Y1 direction of the support portion 410. The protruding portion 411 extends in the Z-axis direction. At a lower end portion of the protruding portion 411, an inclined surface 412 inclined in the Y1 direction toward the below Z2 is provided. The inclined surface 412 is a contact portion which is brought into contact with the protruding portion 29 of the ice making tray 2 from the front in the CCW direction when the ice making tray 2 is rotated from the water storage position 2A in the CCW direction and reaches the ice release position 2B.

Second Frame Portion

The second frame portion 42 includes a rectangular plate portion having a thickness direction directed to the X-axis direction. The third frame portion is connected to an end edge in the Y1 direction of the second frame portion 42. The fourth frame portion 44 is connected to an end edge in the Y2 direction of the second frame portion 42. As shown in FIG. 6, on an end surface in the X1 direction of the second frame portion 42, a plurality of ribs 421 extending in the Z-axis direction are provided. A distal end surface in the X1 direction of each of the ribs 421 is brought into contact with the drive unit 3 from the side in the X2 direction when the drive unit 3 is supported by the support frame portion 45.

Third Frame Portion

As shown in FIGS. 2 and 6, the third frame portion 43 includes a first plate portion 431 extending from the first frame portion 41 in the X2 direction along the side of the ice making tray 2. A first end 601 of the first plate portion 431 opposite to the first frame portion 41 is located between the drive unit 3 and the inclined surface 412 of the first frame portion 41 in the X-axis direction. In addition, the third frame portion 43 includes a second plate portion 432 extending from the second frame portion 42 in the X1 direction along the side of the drive unit 3 at a position which is separated more from the ice making tray 2 in the Y1 direction than the first plate portion 431. A second end 701 opposite to the second frame portion 42 is separated from the first end 601 of the first plate portion 431 in the axis L0 direction. In addition, the third frame portion 43 includes a connecting plate portion 433 which extends in a direction crossing the axis L0 direction and connects the first end 601 and the second end 701 to each other.

More specifically, the first plate portion 431 includes a first wide plate portion 602 extending from the first frame portion 41 to the middle of the first frame portion 41 and the drive unit 3 with the same height dimension as that of the first frame portion 41 and a first extended plate portion 603 extending in the X2 direction from an upper side portion of the first wide plate portion 602. As a result, the first end 601 of the first plate portion 431 opposite to the first frame portion 41 includes a first end portion 604 extending in the Z-axis direction along the edge in the X2 direction of the first extended plate portion 603. Moreover, the first end 601 includes a second end portion 605 extending in the X1 direction along a lower end of the first extended plate portion 603 from the first end portion 604 to the first wide plate portion 602 and a third end portion 606 extending in the Z-axis direction along the edge in the X2 direction of the first wide plate portion 602 and having an upper end portion continuing to the second end portion 605.

The second plate portion 432, on the other hand, includes a second wide plate portion 702 extending in the X1 direction from the second frame portion 42 with the same height dimension as that of the second frame portion 42 and a second extended plate portion 703 extending in the X1 direction from a lower side portion of the second wide plate portion 702. As a result, the second end 701 of the second plate portion 432 opposite to the second frame portion 42 includes a first end portion 704 extending in the Z-axis direction along the edge in the X1 direction of the second wide plate portion 702. Moreover, the second end 701 includes a second end portion 705 extending in the X1 direction from the first end portion 704 along the upper edge of the second extended plate portion 703 and a third end portion 706 extending in the Z-axis direction from the second end portion 705 along the edge in the X1 direction of the second wide plate portion 705. The first end portion 604 of the first plate portion 431 and the first end portion 704 of the second plate portion 432 are separated from each other in the X-axis direction. The third end portion 606 of the first plate portion 431 and the third end portion 706 of the second plate portion 432 are separated from each other in the X-axis direction. Moreover, the second end portion 605 of the first plate portion 431 and the second end portion 705 of the second plate portion 432 are overlapped when viewed from the Y-axis direction.

The connecting plate portion 433 includes a first connecting plate-portion 801 which extends in the Z-axis direction with the thickness direction directed to a direction crossing the X-axis direction and connects the first end portion 604 of the first plate portion 431 and the first end portion 704 of the second plate portion 432 to each other. Moreover, the connecting plate portion 433 includes a second connecting plate portion 802 which extends in the X-axis direction with the thickness direction directed to the Z-axis direction and connects the second end portion 605 of the first plate portion 431 and the second end portion 705 of the second plate portion 432 to each other. Furthermore, the connecting plate portion 433 includes a third connecting plate portion 803 which extending in the Z-axis direction with the thickness direction directed to a direction crossing the X-axis direction and connects the third end portion 606 of the first plate portion 431 the third end portion 706 of the second plate portion 432 to each other.

A notched portion 46 is provided on a lower end portion of the third connecting plate portion 803. As a result, the third frame portion 43 includes the notched portion 46 opened in the X-axis direction to below Z2 between the drive unit 3 and the inclined surface 412 of the first frame portion 41. Here, the wiring 5 pulled out in the X1 direction from the end portion in the Y1 direction of the drive unit 3 is routed along the second wide plate portion 702 of the second plate portion 432 and is routed from the inside to the outside of the frame 4 through the notched portion 46.

Subsequently, the first plate portion 431 includes, on a surface in the Y1 direction, a first plate-portion upper-end rib 501 extending in the X-axis direction along an upper end of the first plate portion 431. Moreover, the first plate portion 431 includes, on a surface in the Y1 direction, a first plate-portion lower-end rib 502 extending in the X-axis direction along a lower end of the first plate portion 431. Furthermore, the first plate portion 431 includes a notched-portion side rib 503 which overlaps the notched portion 46, when viewed from the X-axis direction, in the X1 direction of the notched portion 46 on the surface in the Y1 direction. The notched-portion side rib 503 extends in the Z-axis direction. Here, on the first plate-portion lower-end rib 502, a plate-like protruding portion 49 protruding in the Z1 direction from the end of the Y1 direction is provided. The plate-like protruding portion 49 and the notched-portion side rib 503 are separated from each other in the Y-axis direction. Moreover, the first plate portion 431 includes a lattice-shaped first plate-portion side lattice rib 504 in a region between the first plate-portion upper-end rib 501 and the first plate-portion lower-end rib 502 and excluding a region where the notched-portion side rib 503 is provided. The one second plate portion 432 includes a lattice-shaped second plate-portion rib 505 on a surface in the Y1 direction of the second plate portion 432.

Here, the distal end surface in the Y1 direction of the first plate-portion upper-end rib 501, the distal end surface in the Y1 direction of the first plate-portion lower-end rib 502, the end face in the Y1 direction of the plate-like protruding portion 49 formed on the first plate-portion lower-end rib 502, the distal end surface in the Y1 direction of the first plate-portion side lattice rib 504, and the distal end surface in the Y1 direction of the second plate-portion rib 505 are located on the same virtual plane S. Moreover, a protruding amount of the notched-portion side rib 503 protruding from the first plate portion 431 is smaller than the protruding amount by which the first plate-portion upper-end rib 501, the first plate-portion lower-end rib 502, and the first plate-portion side lattice rib 504 protrude from the first plate portion 431. Accordingly, the distal end surface of the notched-portion side rib 503 is located closer to the first plate portion 431 than the virtual surface S.

Fourth Frame Portion

The fourth frame portion 44 includes a plate portion 441 extending in the X-axis direction with the thickness direction directed to the Y-axis direction and a plurality of ribs 442 protruding in the Y1 direction from the plate portion 441. The plate portion 441 connects the first frame portion 41 and the second frame portion 42 to each other. Moreover, the fourth frame portion 44 includes an opposing plate portion 443 opposed to the plate portion 441 in the Y-axis direction. The opposing plate portion 443 has the same shape as that of the plate portion 441 and connects distal ends of each of the ribs 442. Each of the ribs 442 extends from the upper end to the lower end of the plate portion 441 and the opposing plate portion 443 in the Z-axis direction. The plurality of ribs 442 are in parallel with each other. Here, a through hole 444 which penetrates in the Z-axis direction is formed between the plate portion 441 and the opposing plate portion 443 and between the adjacent ribs 442. The through hole 444 has a substantially rectangular shape when viewed from the Z-axis direction.

Fixing Portion

The fixing portion 7 protrudes upward from the first plate-portion upper-end rib 501 of the third frame portion 43. As shown in FIGS. 3, 4, and 6, in this example, a first fixing portion 71 and a second fixing portion 72 are provided at two locations separated from each other in the X-axis direction as the fixing portion 7.

The first fixing portion 71 is located between the drive unit 3 and the inclined surface 412 provided on the first frame portion 41 in the X-axis direction. In this example, the first fixing portion 71 is provided at a center part in the X-axis direction of the third frame portion 43. Moreover, in this example, the first fixing portion 71 is provided at a position where it overlaps the notched portion 46 formed at the lower end edge of the third frame portion 43 when viewed from the Z-axis direction. In other words, the notched portion 46 is provided at an overlapping position P overlapping the first fixing portion 71 when viewed from the Z-axis direction.

The second fixing portion 72 is provided at a position which overlaps the inclined surface 412 when viewed from the Z-axis direction. Each of the first fixing portion 71 and the second fixing portion 72 includes a plate portion 73 with the thickness direction directed to the Y-axis direction and a pair of reinforcing ribs 74 which protrude in the Y2 direction from both sides in the X-axis direction of the plate portion 73. In the plate portion 73, a through hole 75 that penetrates in the Y-axis direction is provided. An end surface of the plate portion 73 in the Y1 direction is located on the virtual plane S.

When the ice making machine 1 is to be installed in the freezing compartment, a fixing screw is penetrated through each of the through holes 75 of the first fixing portion 71 and the second fixing portion 72 from the side in the Y2 direction so as to fix the frame 4 to the side surface portion of the inner wall surface in the freezing compartment. In a state where the frame 4 is fixed to the side wall portion of the freezing compartment by the fixing screw, the distal end surface of the first plate-portion upper-end rib 501, the distal end surface of the first plate-portion lower-end rib 502, the end surface in the Y1 direction of the plate-like protruding portion 49 formed on the first plate-portion lower-end rib 502, the distal end surface of the first plate-portion side lattice rib 504, and the distal end surface of the second plate-portion rib 505 located on the virtual plane S are brought into contact with the side wall portion of the freezing compartment. Moreover, in a state where the frame 4 is fixed to the side wall portion of the freezing compartment, a clearance is formed between the notched-portion side rib 503 of the first plate portion 431 and the side wall portion.

Here, the wiring 5 pulled out of the frame 4 to an outside of the frame 4 through the notched portion 46 is pulled out in the X1 direction through the clearance between the notched-portion side rib 503 and the side wall portion. In addition, the pulled-out wiring 5 is passed between the notched-portion side rib 503 and the plate-like protruding portion 49 provided on the first plate-portion lower-end rib 502 and held therebetween.

Ice Making Operation

The ice making machine 1 is fixed to the side wall surface of the freezing compartment and makes ice. In an ice making operation, water is supplied to the ice making tray 2 when the ice making tray 2 is at the water storage position 2A. Thereafter, when it is confirmed that a temperature of the ice making tray 2 is below a predetermined temperature on the basis of an output from the thermistor 8 attached to the ice making tray 2, it is assumed that ice making has been completed, and the drive unit 3 is driven for a predetermined period of time. As a result, the drive unit 3 rotates the output shaft 32 in the CCW direction so as to move the ice making tray 2 from the water storage position 2A to the ice release position 2B.

Here, in the ice making machine 1, before the driving of the drive unit 3 is finished, the inclined surface 412 of the frame 4 is brought into contact with the protruding portion 29 of the ice making tray 2. As a result, the ice making tray 2 is further rotated by the drive unit 3 in the CCW direction in a state where the inclined surface 412 is in contact with the protruding portion 29 from the front in the rotation direction. As a result, since the ice making tray 2 is twisted, the ice is removed from the ice making tray 2 and falls. Thereafter, the drive unit 3 reversely rotates the ice making tray 2 in the CW direction so as to return the ice making tray 2 from the ice release position 2B to the water storage position 2A.

Action and Effect

Here, when the ice making tray 2 is twisted, the reaction force of the driving force by which the drive unit 3 rotates the ice making tray 2 acts on the first frame portion 41 of the frame 4 on which the contact portion is provided and the end portion in the X2 direction of the frame 4 in which the drive unit 3 is held. Accordingly, the first frame portion 41 with which the ice making tray 2 is brought into contact is to rotate around the axis L0 in the CCW direction. On the other hand, the end portion in the X2 direction of the frame 4 in which the drive unit 3 is held is to rotate around the axis L0 in the CW direction. This results in distortion in the frame 4. Moreover, in this example in which the fixing portion 7 which fixes the frame 4 to the side surface portion of the freezing compartment protrudes upward from the third frame portion 43, if the frame 4 is distorted when the ice making tray 2 is twisted, such a problem may occur that a lower end portion of the frame 4 in the X2 direction is lifted up from the inner wall surface of the freezing compartment.

In order to address the problem as above, in this example, in the frame 4, the third frame portion 43 having the fixing portion 7 provided is brought into contact with the side surface portion of the freezing compartment by using the fixing portion 7 when fixed to the freezing compartment. Accordingly, when the reaction force of the driving force while the ice making tray 2 is twisted acts on the frame 4, the third frame portion 43 is supported by the side surface portion of the freezing compartment and is suppressed from being distorted. Moreover, in the frame 4, the fourth frame portion 44 opposed to the third frame portion 43 includes the plate portion 441, the plurality of ribs 442, and the opposing plate portion 443 which connects distal ends of the plurality of ribs 442. Therefore, the fourth frame portion 44 has increased rigidity as compared with a case where the fourth frame portion 44 is constituted only by the plate portion 441. Thus, distortion of the frame 4 by the reaction force of the driving force when the ice making tray 2 is twisted can be prevented or suppressed.

Moreover, in this example, each of the ribs 442 extends from an upper end to a lower end of the plate portion 441, and the plurality of ribs 442 extend in parallel. Accordingly, the fourth frame portion 44 has a shape including a plurality of through holes 444 penetrating in the Z-axis direction in a plate member having a thickness which is equal to or larger than the sum of the thickness of the plate portion 441 and the thickness of the opposing plate portion 443. Therefore, when the frame 4 is formed by injection molding of resin, the plurality of through holes 444 extending in the Z-axis direction serve as wall thinning of the thick plate member, which can prevent or suppress occurrence of sink marks on the fourth frame portion 44. Thus, it becomes easy to mold the frame 4 into the desired shape.

Furthermore, in this example, the third frame portion 43 includes the notched portion 46 opened downward at the overlapping position P overlapping the first fixing portion 71 when viewed from the Z-axis direction. The wiring 5 for power feed connected to the drive unit 3 is routed around the inside of the frame 4 from the drive unit 3 to the notched portion 46 and is pulled out to the outside of the frame 4 through the notched portion 46. Accordingly, the wiring 5 connected to the drive unit 3 can be pulled out to the outside of the frame 4.

The first fixing portion 71 and the second fixing portion 72 which fix the frame 4 to the side surface portion of the freezing compartment protrude upward from an end opposite to the fourth frame portion 44 of the first plate-portion side upper-end rib 501. Accordingly, when the frame 4 is to be fixed to the side wall surface of the freezing compartment by using the first fixing portion 71 and the second fixing portion 72, it is easy to bring the side of the third frame portion 43 opposite to the fourth frame portion 44 into contact with the side surface portion of the freezing compartment.

Furthermore, the distal end surface of the first plate-portion upper-end rib 501, the distal end surface of the first plate-portion lower-end rib 502, and the distal end surface of the second plate-portion rib 505 are located on the same virtual plane S and are brought into contact with the side surface portion when the frame 4 is fixed to the side surface portion of the freezing compartment. Accordingly, the third frame portion 43 is supported by the side surface portion of the freezing compartment. In addition, since the distal end surface of the notched-portion side rib 503 is located closer to the first plate portion 431 than the virtual plane S, when the distal end surface of the first plate-portion upper-end rib 501, the distal end surface of the first plate-portion lower-end rib 502, and the distal end surface of the second plate-portion rib 505 are brought into contact with the side surface portion of the freezing compartment, a clearance is formed between the notched-portion side rib 503 and the side surface portion of the freezing compartment. Therefore, when the wiring 5 is pulled out to the outside of the frame 4 through the notched portion 46 formed in the third frame portion 43, the wiring 5 can be routed in the X1 direction from the notched portion 46 by using this clearance. As a result, even when the wiring 5 is pulled out to the outside of the frame 4, the third frame portion 43 can be prevented from being separated from the side surface portion of the freezing compartment.

Here, among the fixing portions 7 which fix the frame 4 to the side surface portion of the freezing compartment, in a configuration in which the first fixing portion 71 is located between the drive unit 3 and the inclined surface 412 in the X-axis direction, and the second fixing portion 72 is located closer to the X1 direction than the first fixing portion 71 in the X-axis direction, if the frame 4 is distorted when the ice making tray 2 is twisted, the lower end portion of the third frame portion 43 and particularly a side closer to the drive source which exerts the driving force which rotates the ice making tray 2 can be easily lifted up from the side surface portion of the freezing compartment. Accordingly, when the notched portion 46 is provided in the third frame portion 43, the rigidity of the third frame portion 43 is reduced, whereby the lower end portion of the third frame portion 43 and the side closer to the drive source is lifted up more easily from the side surface portion of the freezing compartment.

In contrast, in this example, by providing the notched portion 46 at the overlapping position P overlapping the first fixing portion 71 when viewed from the Z-axis direction, the notched portion 46 is provided at a position close to the first fixing portion 71. Accordingly, when the frame 4 is fixed to the inner wall surface of the freezing compartment by using the first fixing portion 71, a state where a vicinity around the notched portion 46 is in contact with the inner wall surface portion of the freezing compartment can be realized easily. As a result, since the vicinity of the notched portion 46 in the third frame portion 43 is supported by the inner wall surface of the freezing compartment when the ice making tray 2 is twisted, occurrence of distortion in the third frame portion 43 can be easily suppressed.

Moreover, in this example, the third frame portion 43 includes the first plate portion 431 extending from the first frame portion 41 in the X2 direction on the side of the ice making tray 2 and having the first end 601 opposite to the first frame portion 41 located between the drive unit 3 and the inclined surface 412 in the X-axis direction, the second plate portion 432 extending from the second frame portion 42 in the X1 direction on the side of the drive unit 3 at the position separated more from the ice making tray 2 than the first plate portion 431 and having the second end 701 opposite to the second frame portion 42 opposed to the first end 601 in the X-axis direction with a clearance between them, and the connecting plate portion 433 which extends in the Z-axis direction and connects the first end 601 and the second end 701 to each other. Moreover, the third frame portion 43 includes the notched portion 46 provided on the lower end portion of the connecting plate portion 433. Accordingly, on the inner wall surface which faces the sides of the ice making tray 2 and the drive unit 3 in the third frame portion 43, a step portion 439 is formed by the first plate portion 431, the second plate portion 432, and the connecting plate portion 433. Moreover, in a lower end portion of the step portion 439 which is the lower end portion of the connecting plate portion 433, the notched portion 46 through which the wiring 5 is pulled out is provided. Here, the second plate portion 432 provided on the side of the drive unit 3 is more separated from the ice making tray 2 than the first plate portion 431. Accordingly, if the wiring 5 connected to the drive unit 3 is routed along the second plate portion 432 and pulled out to the outside of the frame 4 through the notched portion 46, contact of the wiring 5 routed inside the frame 4 with the ice making tray 2 can be prevented or suppressed. Moreover, by providing the notched portion 46 in the step portion 439, bending of the wiring 5 can be suppressed when it is pulled out to the outside through the notched portion 46.

Furthermore, in the first plate portion 431, the first plate-portion upper-end rib 501 extending along the upper end, the first plate-portion lower-end rib 502 extending along the lower end, and the notched-portion side rib 503 located in the X1 direction of the notched portion 46 are provided. Moreover, on the second plate portion 432, the second plate-portion rib 505 is provided. Accordingly, as compared with the case where the third frame portion 43 is constituted only by the first plate portion 431, the second plate portion 432, and the connecting plate portion 433, the rigidity of the third frame portion 43 is improved.

Other Embodiments

The notched portion 46 may be provided closer to the X1 direction than the overlapping position P. In this way, the notched portion 46 can be separated from the drive unit 3. As a result, since occurrence of lowering of the rigidity on the side closer to the drive unit 3 of the third frame portion 43 can be suppressed, lifting-up of the side closer to the drive unit 3 in the third frame portion 43 from the side surface portion of the freezing compartment can be easily suppressed, when the ice making tray 2 is twisted.

Moreover, in the above example, the plurality of ribs 442 provided on the fourth frame portion 44 extend in the Z-axis direction but they may also extend in the X-axis direction.

Furthermore, the opposing plate portion 443 provided on the fourth frame portion 44 may be omitted. Even in this way, compared with the case where the fourth frame portion 44 is constituted only by the plate portion 441, the rigidity of the fourth frame portion 44 is improved and thus, distortion of the frame 4 can be suppressed, when the ice making tray is twisted. Moreover, when the opposing plate portion 443 is omitted, a lattice rib can be provided on the end surface in the Y2 direction of the plate portion 441.

What is claimed is:

1. An ice making machine, comprising:

an ice making tray;

a drive unit to rotate the ice making tray around an axis passing through the ice making tray, the drive unit including an output shaft connected to the ice making tray, and a motor configured to rotate the output shaft;

a framework-shaped frame which encloses the ice making tray and the drive unit;

a fixing portion to fix the framework-shaped frame to a side surface portion of an inner wall surface in a freezing compartment; and wiring for power feed which is connected to the drive unit, wherein the ice making tray and the drive unit are arranged in an axis direction along the axis;

the framework-shaped frame is made of resin and, assuming that a side on which the ice making tray is located in the axis direction is a first direction and a side opposite thereto is a second direction, comprises a first frame portion located in the first direction of the ice making tray, a second frame portion located in the second direction of the drive unit, a third frame portion extending in the axis direction and connecting the first frame portion and the second frame portion, and a fourth frame portion opposed to the third frame portion and connecting the first frame portion and the second frame portion;

the first frame portion comprises a support portion which supports the ice making tray rotatably around the axis, and a contact portion which can contact a portion that is separated from the axis of the ice making tray, from front in a rotation direction of the ice making tray;

the drive unit is held inside the second frame portion, an end portion in the second direction of the third frame portion, and an end portion in the second direction of the fourth frame portion;

the fixing portion protrudes upward from the third frame portion;

the third frame portion contacts the side surface portion when the framework-shaped frame is fixed to the side surface portion;

the fourth frame portion comprises a plate portion which extends in the axis direction with a thickness direction directed to an orthogonal direction orthogonal to the axis direction and connects the first frame portion and the second frame portion to each other, and a plurality of ribs provided on the plate portion; and if the drive unit is driven for a predetermined period of time when the ice making tray is faced upward, the ice making tray is rotated and faced downward, and the contact portion contacts the ice making tray and the ice making tray is twisted before driving of the drive unit is finished;

the ice making machine further comprises as the fixing portion, a first fixing portion and a second fixing portion which protrude upward from two locations separated in the axis direction of the third frame portion;

the first fixing portion is located between the drive unit and the contact portion in the axis direction;

the second fixing portion is located closer to the first direction than the first fixing portion in the axis direction;

the third frame portion comprises a notched portion opened downward at an overlapping position overlapping the first fixing portion when viewed from a vertical direction or closer to the first direction than the overlapping position when viewed from the vertical direction;

the wiring is routed inside the framework-shaped frame from the drive unit to the notched portion and pulled out to an outside of the framework-shaped frame through the notched portion; and the notched portion is provided at the overlapping position.

2. The ice making machine according to claim 1, wherein the fourth frame portion comprises an opposing plate portion which extends in the axis direction and the vertical direction, is opposed to the plate portion, and connects distal ends of the plurality of ribs.

3. The ice making machine according to claim 2, wherein each of the plurality of ribs extends from an upper end to a lower end of the plate portion; and the plurality of ribs extend in parallel.

4. An ice making machine, comprising:

an ice making tray;

a drive unit to rotate the ice making tray around an axis passing through the ice making tray, the drive unit including an output shaft connected to the ice making tray, and a motor configured to rotate the output shaft;

a framework-shaped frame which encloses the ice making tray and the drive unit;

a fixing portion to fix the framework-shaped frame to a side surface portion of an inner wall surface in a freezing compartment; and wiring for power feed which is connected to the drive unit, wherein the ice making tray and the drive unit are arranged in an axis direction along the axis;

the framework-shaped frame is made of resin and, assuming that a side on which the ice making tray is located in the axis direction is a first direction and a side opposite thereto is a second direction, comprises a first frame portion located in the first direction of the ice making tray, a second frame portion located in the second direction of the drive unit, a third frame portion extending in the axis direction and connecting the first frame portion and the second frame portion, and a fourth frame portion opposed to the third frame portion and connecting the first frame portion and the second frame portion;

the first frame portion comprises a support portion which supports the ice making tray rotatably around the axis, and a contact portion which can contact a portion that is separated from the axis of the ice making tray, from front in a rotation direction of the ice making tray;

the drive unit is held inside the second frame portion, an end portion in the second direction of the third frame portion, and an end portion in the second direction of the fourth frame portion;

the fixing portion protrudes upward from the third frame portion;

the third frame portion contacts the side surface portion when the framework-shaped frame is fixed to the side surface portion;

the fourth frame portion comprises a plate portion which extends in the axis direction with a thickness direction directed to an orthogonal direction orthogonal to the axis direction and connects the first frame portion and the second frame portion to each other, and a plurality of ribs provided on the plate portion;

if the drive unit is driven for a predetermined period of time when the ice making tray is faced upward, the ice making tray is rotated and faced downward, and the contact portion contacts the ice making tray and the ice making tray is twisted before driving of the drive unit is finished;

the ice making machine further comprises as the fixing portion, a first fixing portion and a second fixing portion which protrude upward from two locations separated in the axis direction of the third frame portion;

the first fixing portion is located between the drive unit and the contact portion in the axis direction;

the second fixing portion is located closer to the first direction than the first fixing portion in the axis direction;

the third frame portion comprises a notched portion opened downward at an overlapping position overlapping the first fixing portion when viewed from a vertical direction or closer to the first direction than the overlapping position when viewed from the vertical direction;

the wiring is routed inside the framework-shaped frame from the drive unit to the notched portion and pulled out to an outside of the framework-shaped frame through the notched portion;

the third frame portion comprises:

a first plate portion which extends from the first frame portion in the second direction on a side of the ice making tray and has a first end opposite to the first frame portion located between the drive unit and the contact portion in the axis direction, a second plate portion which extends from the second frame portion in the first direction on a side of the drive unit at a position more separated from the ice making tray than the first frame portion and has a second end opposite to the second frame portion, which is separated from the first end in the axis direction, a connecting plate portion which extends in a direction crossing the axis and connects the first end and the second end to each other, and the notched portion provided on a lower end portion of the connecting plate portion;

on a surface opposite to the fourth frame portion of the first plate portion, a first plate-portion upper-end rib which extends in the axis direction along an upper end of the first plate portion, a first plate-portion lower-end rib which extends in the axis direction along a lower end of the first plate portion, and a notched-portion side rib which overlaps the notched portion when viewed from the axis direction in the first direction of the notched portion are provided;

on a surface opposite to the fourth frame portion of the second plate portion, a second plate-portion rib is provided;

the first fixing portion and the second fixing portion protrude upward from an end opposite to the fourth frame portion of the first plate-portion upper-end rib;

a distal end surface of the first plate-portion upper-end rib, a distal end surface of the first plate-portion lower-end rib, and a distal end surface of the second plate-portion rib are located on a same virtual plane and are brought into contact with the side surface portion when the framework-shaped frame is fixed to the side surface portion; and a distal end surface of the notched-portion side rib is located closer to the first plate portion than the virtual plane.

5. The ice making machine according to claim 4, wherein the fourth frame portion comprises an opposing plate portion which extends in the axis direction and the vertical direction, is opposed to the plate portion, and connects distal ends of the plurality of ribs.

6. The ice making machine according to claim 5, wherein each of the plurality of ribs extends from an upper end to a lower end of the plate portion; and the plurality of ribs extend in parallel.

* * * * *